US007264264B2

(12) United States Patent
Girard

(10) Patent No.: US 7,264,264 B2
(45) **Date of Patent: *Sep. 4, 2007**

(54) BINDING DEVICE HAVING A PIVOTABLE ARM

(75) Inventor: François Girard, Veyrier du Lac (FR)

(73) Assignee: Salomon S.A., Metz-Tessy (FR)

( * ) Notice: Subject to any disclaimer, the term of this patent is extended or adjusted under 35 U.S.C. 154(b) by 0 days.

This patent is subject to a terminal disclaimer.

(21) Appl. No.: 11/465,039

(22) Filed: Aug. 16, 2006

(65) Prior Publication Data

US 2006/0273551 A1 Dec. 7, 2006

Related U.S. Application Data

(63) Continuation of application No. 10/865,901, filed on Jun. 14, 2004, now Pat. No. 7,111,865.

(30) Foreign Application Priority Data

Jun. 18, 2003 (FR) ..... 03 07310

(51) Int. Cl.
*A63C 9/00* (2006.01)

(52) U.S. Cl. ..... 280/623; 280/615; 280/613

(58) Field of Classification Search ..... 280/623, 280/615, 613, 614, 616, 618, 619, 631, 632, 280/633, 11.3, 11.14, 11.15; 36/117.2
See application file for complete search history.

(56) References Cited

U.S. PATENT DOCUMENTS 4,907,817 A 3/1990 Schwarz
5,125,680 A 6/1992 Bejean et al.
5,152,546 A 10/1992 Dunand et al.
5,207,446 A 5/1993 Arnulf et al.
5,282,642 A 2/1994 Provence
5,671,941 A 9/1997 Girard
5,924,719 A 7/1999 Girard (Continued)

FOREIGN PATENT DOCUMENTS

EP 0 679 416 A1 11/1995

(Continued)

OTHER PUBLICATIONS

U.S. Appl. No. RE. 10/233,620, filed Sep. 4, 2002 Gierveld et al.

*Primary Examiner*—Hau Phan
(74) *Attorney, Agent, or Firm*—Greenblum & Bernstein, P.L.C.

(57) ABSTRACT

A device for binding a boot to a sports article allowing the heel of the boot to be raised with respect to the sports article, of the type in which the boot has a first connecting zone positioned at the front of the boot, and a second connecting zone positioned rearward of the first connecting zone. The device includes an attachment arm having a fixed length, the attachment arm being articulated to the base of the device at a first of two fixed points of the attachment arm and adapted to be joined to the second connecting zone of the boot at a second of the two fixed points of the attachment arm. A guiding mechanism slidably guides the first boot connecting zone relative to the base of the device.

16 Claims, 3 Drawing Sheets

U.S. PATENT DOCUMENTS

| | | | | |
|---|---|---|---|---|
| 5,944,337 | A | 8/1999 | Girard et al. | |
| 6,017,050 | A | 1/2000 | Girard | |
| 6,113,111 | A | 9/2000 | Gierveld et al. | |
| 6,152,458 | A | 11/2000 | Edauw et al. | |
| 6,209,903 | B1 | 4/2001 | Girard | |
| 6,289,610 | B1 | 9/2001 | Girard et al. | |
| 6,390,494 | B2 | 5/2002 | Gignoux et al. | |
| 6,499,761 | B1 | 12/2002 | Quellais | |
| 6,964,428 | B2 | 11/2005 | Quellais et al. | |
| 6,986,526 | B2 | 1/2006 | Haughlin | |
| 7,111,865 | B2 * | 9/2006 | Girard | 280/623 |
| 2001/0002747 | A1 | 6/2001 | Gignoux et al. | |
| 2004/0056449 | A1 | 3/2004 | Girard et al. | |

FOREIGN PATENT DOCUMENTS

| | | | |
|---|---|---|---|
| EP | 0 768 103 | A1 | 4/1997 |
| EP | 0 890 379 | A1 | 1/1999 |
| EP | 0 913 102 | A1 | 5/1999 |
| EP | 0 913 103 | A1 | 5/1999 |
| EP | 1 106 218 | A1 | 6/2001 |
| FR | 2 650 192 | A | 2/1991 |
| FR | 2 727 060 | A | 5/1996 |
| FR | 2 739 788 | A | 4/1997 |
| FR | 2 803 178 | A | 7/2001 |
| WO | WO-01/93963 | A1 | 12/2001 |

* cited by examiner

BINDING DEVICE HAVING A PIVOTABLE ARM

CROSS-REFERENCE TO RELATED APPLICATIONS

This application is a continuation of U.S. patent application Ser. No. 10/865,901, filed on Jun. 14, 2004, now U.S. Pat. No. 7,111,865 the disclosure of which is hereby incorporated by reference thereto in its entirety and the priority of which is hereby claimed under 35 U.S.C. §120.

This application is based upon French Patent Application No. 03.07310, filed Jun. 18, 2003, the disclosure of which is hereby incorporated by reference thereto in its entirety and the priority of which is hereby claimed under 35 U.S.C. §119.

BACKGROUND OF THE INVENTION

1. Field of the Invention

The invention relates to the field of devices for binding a shoe or boot to a sports article and, more particularly, the invention relates to the types of bindings that the heel of the boot to be raised with respect to the sports article.

Binding devices of the aforementioned type are used, for example, in cross-country skiing, ski touring, Telemark skiing, snowshoeing, ice skating, and roller skating.

2. Description of Background and Relevant Information

Binding devices are known in the sport of cross-country skiing, in which the front of the boot has a journal pin that is received in a jaw of the binding. The boot then describes a mere rotational movement with respect to the ski to which it is coupled These types of devices generally have a fixed elastic buffer against which the front end of the boot is compressed when the heel is raised, so as to push the boot back to a lowered position. Such a system is described, for example, in French Patent Publication No. 2 650 192 and in U.S. Pat. No. 5,152,546.

Other systems have been proposed in which the boot has a second zone for connecting to the binding, in addition to the first front articulation zone. This second zone is generally connected to a system for the elastic return of the boot. French Patent Publication No. 2 739 788 and U.S. Pat. No. 6,017,650 disclose a device in which a connecting rod having a fixed length is articulated on the second zone for connecting the boot (in this case a pin/axis), on the one hand, and on a sliding carriage that compresses a return spring, on the other hand. In the European Patent Publication No. 1 106 218 and U.S. Patent Application Publication No. 2001/0002747, the connecting rod is articulated at two fixed points but has a variable length, here again to ensure a return function. In both cases, the connecting rod does not in any way affect the trajectory of the boot with respect to the connecting member, which trajectory is therefore an arc of a circle about the connecting zone located at the front of the boot.

French Patent Publication No. 2 727 060 discloses a binding device provided with a flexible connecting rod, one end of which is fixed, connected by nesting to the base of the binding, and the second end of which is connected to a pin arranged behind the front end of the boot. The front end of the boot has a longitudinal groove that cooperates with a complementary rib of the binding in order to cooperate in the transverse guiding of the boot with respect to the binding.

International Patent Publication No. WO 01/93963 and U.S. Patent Application Publication No. 2003/0168830 disclose a system having a connecting rod with a fixed length, which is connected at its two ends to the base of the binding and to a rear engagement element of the boot, respectively. The device has a second connecting rod that is connected to a sliding carriage of the base, on the one hand, and to a front engagement element, on the other hand. This system has the drawback of not providing good stability to the boot in torsion about a vertical axis. Indeed, during such a force (which is particularly present when performing a turning step or a skating step in cross-country skiing), the boot causes a displacement of the sliding carriage on which the second connecting rod is articulated. The return force of the spring that acts on the carriage is insufficient to enable the boot to be held efficiently in torsion. Furthermore, this system does not allow any retention of the front of the boot if the user loses his/her balance rearwardly, the front of the boot then being free to be raised.

SUMMARY OF THE INVENTION

An object of the present invention is to propose a binding device which, while being simple, reliable, and inexpensive to manufacture, allows a relative movement of the boot with respect to the sports article that better approximates the natural rolling movement of the foot when walking.

To this end, the invention is directed to a device for binding a boot to a sports article, which allows the heel of the boot to be raised with respect to the sports article, the device comprising the type in which the boot has a first connecting zone arranged in the area of the front of the boot, and a second connecting zone located behind the first connecting zone. The binding device of the invention further includes an attachment arm, having a fixed length, which includes two fixed articulation points, a first of which the attachment arm is articulated to a base supported on the sports article, and a second of which the attachment arm is joined to boot at the second connecting zone therefor, with the first connecting zone for the boot being slidingly guided on the device.

BRIEF DESCRIPTION OF THE DRAWINGS

Other characteristics and advantages of the invention will become apparent from reading the following description, with reference to the attached drawings, showing an exemplary non-limiting embodiment of the invention, in which.

DETAILED DESCRIPTION OF THE INVENTION

Figure 1:
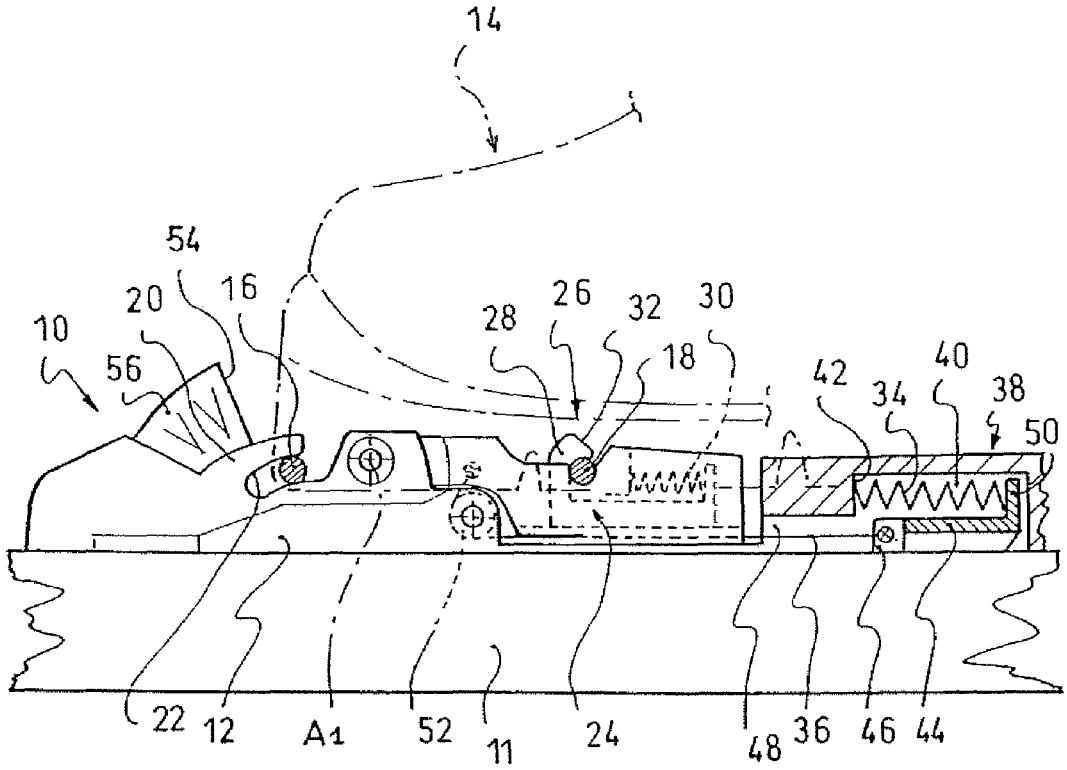
FIG. 1 is a schematic side view of the device consistent with the teachings of the invention positioned atop a ski, the ski being shown cutaway rearward and forward of the binding device, FIG. 1 showing the device in a first position in which the user's boot is not raised from the ski.

The invention is hereafter described in an embodiment in which the binding device is more particularly adapted to cross-country skiing, although the invention encompasses other fields as well, as mentioned above. The binding device 10 shown in FIGS. 1 and 2 thus has a base 12 adapted to be attached to a sports article 11, but which could also be directly integrated into the latter. The base 12 could also be made in several portions, some of which portions being integrated or not integrated into the sports article 11.

According to the invention, the device is adapted to ensure the binding of a boot having two connecting zones. Although the term "boot" is employed here, the term is not to be regarded as limiting the invention and, in this regard, the term is intended to encompass any type of article of footwear within the teachings of the invention. In the example shown, the boot 14 has two anchoring members 16, 18 that are arranged in the boot sole so as to be flush beneath the latter, i.e., such as by not projecting downwardly beyond the walking surface of the sole of the boot. Anchoring members 16, 18 of this type are described in European Patent Application Nos. 0 913 102 and 0 913 103, as well as in U.S. Pat. Nos. 6,017,050 and 6,289,610, the disclosures of which U.S. patents are hereby incorporated by reference thereto in their entireties and to which reference can be made regarding further details. Thus, in this case, the anchoring members 16, 18 take the form of two cylindrical pins which extend across a longitudinal groove/channel provided within the lower surface of the sole. The front pin 16 is positioned, for example, in the area of the front end of the sole, and the rear pin 18 is offset rearwardly from the front pin and is positioned in the area of, or in front of, a zone of the boot corresponding to the metatarsophalangeal flexion zone of the user's foot. This arrangement of the connecting zones is particularly appreciated in cross-country skiing, as it allows, with a boot having a flexible sole, a flexion of the boot to correspond to that of the user's foot. However, the invention could be implemented with anchoring members having a different geometry. Each of the anchoring members therefore constitutes, with the corresponding portion of the groove of the sole, an exemplary zone for connecting the boot to the ski or other sports article.

The binding device according to the invention has, at the front of the base 12, a fixed hook or fastening member 20 demarcating a slot 22 open longitudinally upward and/or rearward, and which is provided to receive the front pin 16 of the boot. The slot 22 has a height that is substantially identical to or slightly greater than the diameter of the front pin, such that the front pin is received in the slot with a minimum clearance in the vertical direction. As can be seen in the drawing figures, the slot 22 does not necessarily have an elongated profile along a rectilinear trajectory. Instead, in the example shown, the slot 22 has a curved profile that slopes forward and downward, a downwardly facing concavity. Thus, when the front pin 16 of the boot is guided in a longitudinal displacement in the slot 22, which it is free to do as the rear of the boot is raised and lowered relative to the ski, for example, the pin is guided vertically along a trajectory, or path, determined by the shape of the slot.

The fastening member 20, or guiding mechanism, is arranged above the upper surface of the base 12 of the binding device. The member 20 is adapted to be received within the longitudinal groove of the boot, such that, through a cooperation of shapes, the member 20 cooperates in guiding the boot translationally in a transverse direction (perpendicular to the plane of the drawing figures) and rotationally along a vertical plane. In this way, the member 20 substantially has the same width as the corresponding cross section of the groove of the boot, and the slot 22 of the binding device opens out transversely in the two lateral surfaces of the member 20.

According to the teachings of the invention, the binding device 10 has an attachment arm 24 with a fixed length, which is articulated/joined at two fixed points, a first on the base 12 of the device, namely the transverse axis A1, on the one hand, and the second on the second zone for connecting the boot, namely the rear pin 18 in this case, on the other hand. The attachment arm 24 is articulated, or pivoted, on the base 12 through its front end about a transverse axis A1 that is positioned rearward of the member 20.

The attachment arm 24 also has an automatic latch 26, on its rear portion, which is provided to receive the rear cylindrical pin 18 of the boot. According to this embodiment, the automatic latch 26 has a fixed jaw in the form of an upwardly open groove, and a slidably movable jaw 28 that is provided with an elastic return mechanism 30 to push it back rearward to its closed position shown in the drawing figures. In this position, the two jaws define a housing whose cross section corresponds to that of the rear pin 18 of the boot 14. The movable jaw 28 has an inclined ramp 32 that is arranged such that, when the pin 18 exerts a substantially vertical top down force on the ramp 32, it pushes the movable jaw 28 back forward, toward an open position in which it allows access to the groove. When the pin 18 has penetrated into the groove, the return mechanism 30 of the movable jaw 28 returns the jaw to its closed position. The pin 18 is then confined and locked in the housing defined by the latch 26, while allowing a relative rotational movement of the pin 18 with respect to the attachment arm 24, about the axis of the cylindrical pin 18.

As can be seen in the drawing figures, the attachment arm 24 is preferably received within the groove of the sole, and its dimensions are preferably provided so that the attachment arm 24 also cooperates in the transverse guiding of the boot.

In its low position shown in FIG. 1, the attachment arm 24, at rest, is oriented substantially horizontally. In this position, it is possible to hook the boot to the binding device in a very simple manner. To this end, it suffices to engage the front pin 16 of the boot in the slot 22 and then, by rotation about the front pin 16, to lower the boot in order to lock the rear pin 18 on the attachment arm 24. It is noted that the latch 26 that receives the rear pin 18 of the boot is arranged behind the axis A1 for articulating the attachment arm 24 on the device 10.

Once the boot is latched in this manner, it is the attachment arm 24 that controls the relative movement of the boot with respect to the sports article. With the arrangement of the invention, the rear pin of the boot describes an arc-of-a-circle trajectory about the journal axis A1 of the attachment arm 24 on the base when the heel of the boot is raised with respect to the sports article. Indeed, once the rear pin 18 is locked on the attachment arm 24, it remains at a constant distance from the axis A1. During this completely predetermined movement of the rear pin 18, i.e., of a zone of the boot that corresponds substantially to the metatarsophalangeal articulation of the user's foot, the front pin 16 is free longitudinally and is displaced in the slot 22, in this case toward the front of the slot. Thus, in the illustrated embodiment, the path of the front pin 16 does not describe an arc of a circle about axis A1, but describes a path defined by a series of points spaced at varying distances from axis A1. That is, while being displaced longitudinally, the front pin 16 is completely guided along a trajectory or path defined by the profile of the slot 22 of the guiding mechanism 20. In the example shown, the slot 22 controls a downward displacement of the front pin 16 when the heel of the boot is raised. This sloping movement can be felt particularly at the end of the movement.

The overall kinematics of the device according to the invention are therefore mainly provided by the attachment arm 24, but it is also affected by the geometry of the guiding slot 22. The slot 22, within the scope of the invention, can have a profile other than the one shown here.

Furthermore, one can see that, when the boot is in the low position, as shown in FIG. 1, the front end of the boot cannot be raised vertically upward, due to the front pin 16 that is blocked in this direction in the slot 22.

The binding device 10 also has a system for the elastic return of the attachment arm 14 to its low position.

Advantageously, the elastic return system has at least one elastic member 34 that is connected to the sports article 11 and a flexible link 36 that connects the elastic member 34 to the attachment arm 24, and which cooperates with at least one guide/return member 52.

In the example shown, the binding device 10 has a guiding rib 38, or rib portion, having a paralellepipedic cross-sectional shape which extends longitudinally rearward, behind the attachment arm 24. As known, this guiding rib 38 is provided to cooperate with the groove having a complementary cross-section and arranged in the sole of the boot to ensure a lateral guiding of the boot/binding assembly. This guiding rib 38 therefore extends the member 20 and attachment arm 24 toward the rear, i.e., all of the elements 20, 24, 38 are adapted to become nested within the groove of the shoe/boot. Advantageously, the elastic member 34 is integrated into a housing 40 provided within the rib 38. In the example shown, the elastic member 34 is a compression spring that is arranged horizontally and longitudinally in the housing 40. The front end of the spring 34 is in support against a front surface 42 of the housing 40. The front end of the spring is therefore fixed. The rear end of the spring is in support against a movable carriage 44 that can slide longitudinally with respect to the base 12 and with respect to the rib 38. More specifically, the carriage 44 has a front end 46 that is displaced in the area of a front opening 48 of the housing 40, and a rear end 50 that is displaced in the housing 40, and on which the rear end of the spring 34 takes support.

Such an arrangement of an elastic member and of a movable carriage is similar to the one found in the device described in the European Patent Publication No. 0 768 103, in U.S. Pat. No. 6,017,050, the disclosure of which is hereby incorporated by reference in its entirety, and in certain cross-country ski binding devices marketed by the assignee. However, unlike these devices in which the elastic member is connected to the boot by a connecting rod, the device shown here has a flexible link 36 that connects the elastic member 34 to the attachment arm 24.

Figure 3:
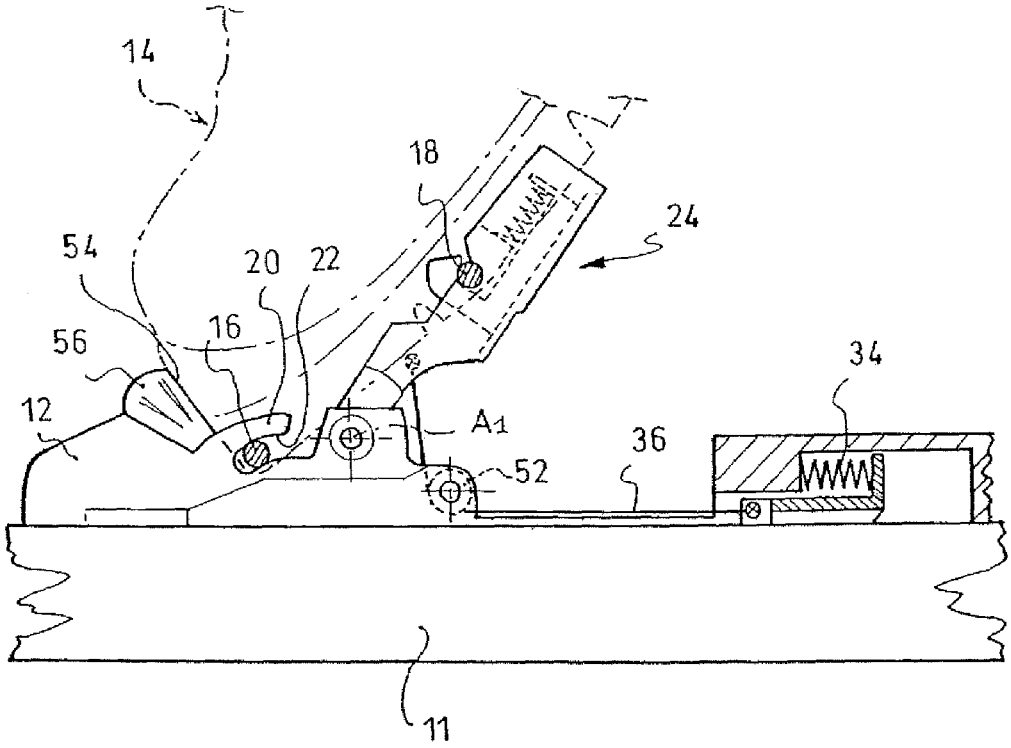
FIG. 3 is a view like that of FIGS. 1 and 2, showing the device of the invention in a third position, more fully raised from the ski.

As can be seen in the drawing figures, the link 36 is not directly connected to the elastic member 34, but rather to the front end 46 of the carriage 44. It passes over a return/guide 52 which, according to the illustrated embodiment, takes the form of a pulley mounted on the base. Alternatively, the return/guide 52 could also take the form of a mere fixed sliding surface, which would preferably be curved. The other end of the flexible link 36 is connected to the attachment arm 24 such that the portion of the flexible link 36 that extends between the return/guide 52 and the attachment arm 24 is substantially vertical, so that the return force exerted on the attachment arm 24 is directed primarily downward, including when the attachment arm is in the raised position as shown in FIG. 3. Conversely, the portion of the link 36 that extends from the return/guide 52 to the elastic member 34 extends along a substantially horizontal direction.

As can be seen from the drawing figures, when the attachment arm 24 moves from its low position to a raised position, the flexible link 36 pulls the movable carriage 44 forward and causes the compression of the spring 34, which therefore provides a return force that tends to return the boot toward a horizontal position with respect to the sports article.

According to a particular embodiment, the flexible link 36 is inextensible or at least substantially inextensible. For example, the flexible link can take the form of a metallic cable or a cable made of very low extensibility fibers, for example, a cable made of aramid fibers. Thus, the link can be made in the form of a band. This traction band can be made in the form of a metal strip, for example, or in the form of a harness of parallel fibers embedded in a polymeric material. Preferably, the link is sufficiently supple and flexible in order not to generate any noticeable elastic effect, and in particular to support a bevel gear of about 90 degrees.

Figure 2:
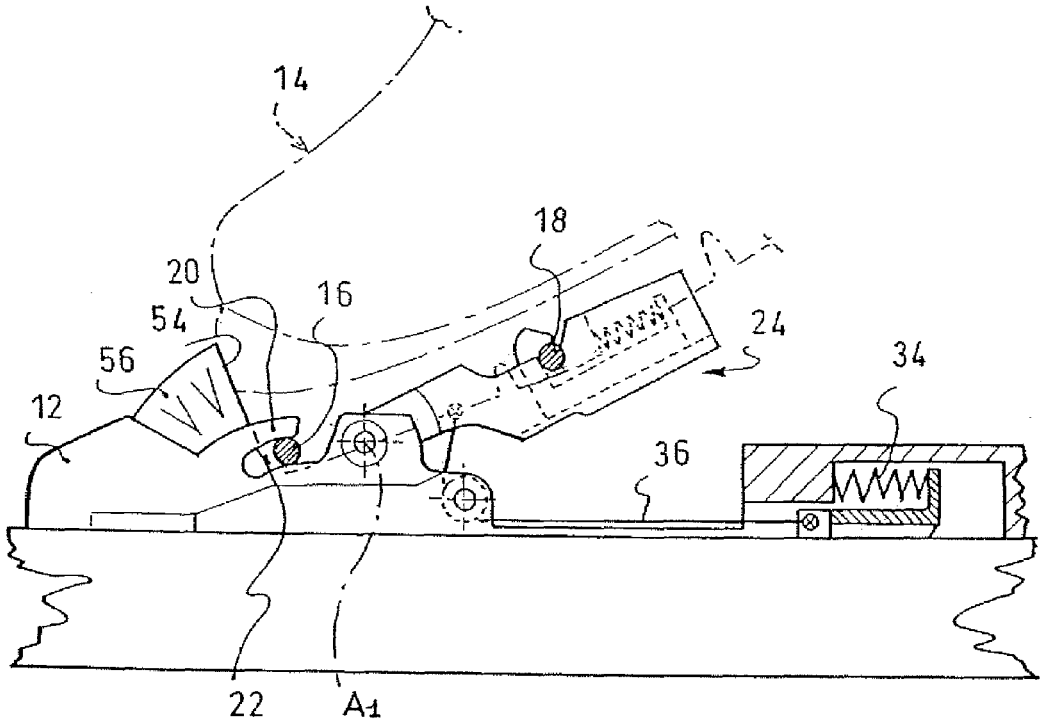
FIG. 2 is a view like that of FIG. 1, showing the device of the invention in a second, or intermediate, position raised from the ski.

FIG. 2 shows a raised intermediate position of the boot in which the front portion of the boot sole abuts against a support surface 54. In a particular embodiment, the support surface 54 is elastic and, for example, is made in the form of a buffer 56 mounted at the front of the base 12. A purpose of the support surface 54 is to introduce a marking element by means of which the user can "recognize" or "feel" a reference position.

If the user continues the movement of raising the heel of the boot, to the position shown in FIG. 3, this movement will be done by compressing the elastic buffer 56.

The reference position is here determined by a support surface 54 connected to the base 12, therefore the sports article 11, and on which the front end of the boot sole takes support. However, this support surface 54 could cooperate with another portion of the boot. One can also provide that this reference surface be made in the form of a small elastic buffer arranged at, or in, the front end of the slot 22. In this case, it will cooperate with the front pin 16. Moreover, the support surface 54 shown in the drawing figures is fixed, but its longitudinal position could be adjustable by the user, particularly so that the user can adapt the reference position to the length of his/her stride.

In the example shown, between the intermediate position of FIG. 2 and the extreme position of FIG. 3, the elastic buffer provides a return force that is complementary to that of the main return device comprised by the spring 34 and the flexible link 36.

As explained above, although the second pin 18 of the boot, i.e., a second of two connecting zones of the boot, is confined within and locked in the housing defined by the latch 26 of the attachment arm 24 during raising and lowering of the heel of the boot during use, rotation of the pin 18 about its axis is allowed relative to the attachment arm. Such rotational movement of the pin 18 is necessary, as can be understood by comparing the relative positions in FIGS. 1-3 between the attachment arm 24 and the two pins 16, 18, or between the attachment arm and the sole (shown in broken lines in the drawing figures). For example, relative to a straight line extending through the axes of pins 16, 18, the position of the pivot axis A1 connecting the attachment arm 24 to the base 12 moves downwardly as the heel of the boot is raised from the lower position in FIG. 1 to the raised position in FIGS. 2 and 3. Likewise, an angle between a line extending along the bottom of the attachment arm 24 in FIG. 3 and the aforementioned line intersecting pins 16, 18 decreases as the heel of the boot is lowered to the FIG. 1 position.

To unlatch the boot from the device according to the invention, one can provide, for example, that a pull handle (not show) be connected to the movable jaw 28 in order to bias it forward against the spring 30, to cause the latch 26 to unlock. Thus, one will first allow the release of the rear pin 18, vertically upward; then the release of the front pin 16, longitudinally rearward and/or upward.

Therefore, the invention makes it possible to obtain a binding device whose construction is particularly simple, but which controls an ergonomic movement of the boot with respect to the sports article, this movement approximating the natural rolling movement of the foot.

The invention claimed is:

1. A device for binding a boot to a sports article, the device allowing a heel of the boot to be raised relative to the sports article, the boot having a first connecting zone at the front of the boot and a second connecting zone behind the first connecting zone, said device comprising:

(a) a base adapted to be supported on the sports article;

(b) a kinematics arrangement for the device comprising:

(1) an attachment arm having two fixing points separated by a fixed distance during raising and lowering of the heel of the boot relative to the sports article, the two fixing points of the attachment arm comprising:

(A) a first fixing point articulating the attachment arm relative to the base; and (B) a second fixing point positioned rearward of the first fixing point, the second fixing point being adapted to be joined to the second connecting zone of the boot;

(2) a guiding mechanism for guiding movement of the first connecting zone of the boot relative to the attachment arm during the raising and lowering of the heel relative to the sports article.

2. A device according to claim 1, wherein:

the guiding mechanism guides movement of the first connecting zone of the boot relative to the base during raising and lowering of the heel relative to the sports article.

3. A device according to claim 1, wherein:

the first fixing point of the attachment arm is positioned longitudinally between the first and second connecting zones for the boot.

4. A device according to claim 1, further comprising:

a return mechanism to apply an elastic return force in a direction for lowering the heel relative to the sports article.

5. A device according to claim 4, wherein:

the return mechanism comprises a compressible elastic buffer positioned on the base for engaging a front portion of the boot after the heel of the boot has been raised relative to the sports article.

6. A device according to claim 1, wherein:

the guiding mechanism of the base comprises a guide for allowing longitudinal movement of the first connecting zone of the boot relative to the base, while constraining transverse and vertical movement of the first connecting zone of the boot to move along a predetermined path.

7. A device according to claim 1, wherein:

the second connecting zone of the boot comprises a transverse cylindrical articulation pin fixed in place in a lower portion of the sole of the boot.

8. A device according to claim 1, wherein:

the guiding mechanism guides movement of the first connecting zone of the boot relative to the attachment arm along a path during the raising and lowering of the heel relative to the sports article.

9. A device according to claim 1, wherein:

the guiding mechanism guides movement of the first connecting zone of the boot relative to the attachment arm along a linear path during the raising and lowering of the heel relative to the sports article.

10. A device according to claim 1, wherein:

the guiding mechanism guides movement of the first connecting zone of the boot relative to the attachment arm along a path defined by a series of points spaced at different distances from said first fixing point during the raising and lowering of the heel relative to the sports article.

11. A device according to claim 1, wherein:

an entirety of the attachment arm is always in non-engagement with the base during the raising and lowering of the heel relative to the sports article.

12. A device according to claim 1, wherein:

the guiding mechanism comprises a guiding slot for guiding a transversely extending member of the first connecting zone of the boot within said slot during the raising and lowering of the heel relative to the sports article.

13. A device according to claim 1, further comprising:

a compressible elastic buffer supported on the base for engaging a front end of the boot after the heel of the boot has been raised relative to the sports article.

14. A device for binding a boot to a sports article, the device allowing a heel of the boot to be raised relative to the sports article, the boot having a first connecting zone at the front of the boot and a second connecting zone behind the first connecting zone, said device comprising:

(a) a base adapted to be supported on the sports article;

(b) a kinematics arrangement for the device comprising:

(1) an attachment arm having two fixing points separated by a fixed distance during raising and lowering of the heel of the boot relative to the sports article, the attachment arm including a releasable latching mechanism to join the attachment arm to the boot by latching the second connecting zone of the boot, the two fixing points of the attachment arm comprising:

(A) a first fixing point articulating the attachment arm relative to the base; and (B) a second fixing point positioned rearward of the first fixing point, the second fixing point being adapted to be joined to the second connecting zone of the boot;

(2) a guiding mechanism for guiding movement of the first connecting zone of the boot relative to the attachment arm during the raising and lowering of the heel relative to the sports article.

15. A device for binding a boot to a sports article, the device allowing a heel of the boot to be raised relative to the sports article, the boot having a first connecting zone at the front of the boot and a second connecting zone behind the first connecting zone, said device comprising:

(a) a base adapted to be supported on the sports article;

(b) a kinematics arrangement for the device comprising:

(1) an attachment arm having two fixing points separated by a fixed distance during raising and lowering of the heel of the boot relative to the sports article, the two fixing points of the attachment arm comprising:

(A) a first fixing point articulating the attachment arm relative to the base; and (B) a second fixing point positioned rearward of the first fixing point, the second fixing point being adapted to be joined to the second connecting zone of the boot;

(2) a guiding mechanism for guiding movement of the first connecting zone of the boot relative to the attachment arm during the raising and lowering of the heel relative to the sports article;

the first connecting zone of the boot comprising a transverse pin fixed in place in a lower portion of the sole of the boot; and the guiding mechanism of the base comprising a guiding slot for receiving and guiding the transverse pin of the first connecting zone of the boot.

16. A device according to claim 9, wherein:

the guiding slot of the guiding mechanism of the base has an open longitudinal end to allow the transverse pin of the first connecting zone of the boot to be received within the guiding slot.

* * * * *